US006394547B1

(12) United States Patent
Vik

(10) Patent No.: US 6,394,547 B1
(45) Date of Patent: May 28, 2002

(54) ERGONOMIC CHAIR

(76) Inventor: David J. Vik, 4700 El Camino Real, Los Altos, CA (US) 94022

( * ) Notice: Subject to any disclaimer, the term of this patent is extended or adjusted under 35 U.S.C. 154(b) by 0 days.

(21) Appl. No.: 09/602,904

(22) Filed: Jun. 23, 2000

(51) Int. Cl.[7] ..... A47C 3/00

(52) U.S. Cl. ..... 297/298; 297/353; 297/383; 297/344.19; 297/423.26; 297/452.29

(58) Field of Search ..... 297/383, 353, 297/298, 296, 452.3, 452.31, 452.32, 452.29, 423.1, 423.19, 423.26, 423.38, 344.12, 344.18, 344.19, 361.1, 354.12

(56) References Cited

U.S. PATENT DOCUMENTS 2,437,940 A * 3/1948 Cramer et al.
3,989,297 A 11/1976 Holt
4,099,774 A * 7/1978 Sandham
5,035,466 A 7/1991 Mathews et al.
5,249,839 A 10/1993 Faiks et al.
5,385,388 A 1/1995 Faiks et al.
5,577,802 A 11/1996 Cowan et al.

* cited by examiner

*Primary Examiner*—Milton Nelson, Jr.
(74) *Attorney, Agent, or Firm*—Gregory Scott Smith and Associates

(57) ABSTRACT

A seat or chair that includes a seat back that is moveable so that it may be positioned to provide primary support to the spine and surrounding tissue centered on the region between the $2^{nd}$ lumbar vertebrae and the $11^{th}$ thoracic vertebrae of a user of the chair. Support in this region assists the spine in maintaining a good posture, and may also partially support the weight of the spine above the lumbar region of the spine. Another aspect of the seat or chair comprises a seat or chair configuration that provides a selected degree of traction applied to the lumbar region of the spine when the user leans back in the seat or chair.

7 Claims, 3 Drawing Sheets

ERGONOMIC CHAIR

FIELD OF THE INVENTION

The present invention relates generally to ergonomic chairs or seats. More particularly, the invention relates to chairs or seats that are configured to provide effective and comfortable back support.

DESCRIPTION OF RELATED ART

A very large number of articles for sitting are available on the market, many of which purport to provide comfortable and ergonomically effective support for the back. However, such pre-existing chair and seat designs are frequently complicated, expensive, and provide ineffective support of the spine. Furthermore, while many of these seats or chairs can be adjusted to suit a particular individual when seated in a single position, the chairs do not generally provide effective ergonomic support of the spine if the user moves. For example, the spatial relationship between the backrest and the seat of a chair in many pre-existing chair designs will change to a negative or less comfortable relationship with the user's back when the user leans back in the seat or chair.

What is needed is a seating device such as a chair or seat that is relatively simple and inexpensive to construct, that provides back support that is superior to the support provided by preexisting chair designs, and that will also provide effective support to a users back and spine when the user leans back in the chair.

SUMMARY OF THE INVENTION

Accordingly, the present invention comprises a seat or chair configuration that supports the users back at the junction between the lower thoracic vertebrae and the upper lumbar vertebrae and surrounding tissues. Support in this region assists the spine in maintaining a good posture, and also partially supports the weight of the spine above the lumbar region of the spine, which reduces the compressive forces experienced by the lumbar region of the spine. Another aspect of the invention comprises a seat or chair configuration that provides a selected degree of traction applied to the lumbar region of the spine when the user leans back in the seat or chair.

The invention may be incorporated into many other kinds of chairs or other kinds of seating, including but not limited to car seats, sofas, and the like. A preferred embodiment of the chair comprises a seat support structure, a seat operably connected to the support structure, and a backrest that is positionable to provide primary support to the spine in the region between the $1^{st}$ lumbar vertebrae and the $12^{th}$ thoracic vertebrae of a user of the chair, and in some embodiments may also support the region between the $11^{th}$ thoracic vertebrae and the $2^{nd}$ nd lumbar vertebrae. The force applied by the backrest preferably includes both a vertical component or vector and a horizontal component or vector. The vertical vector partially supports the weight of the user above the lumbar region of the spine preferably reducing the compressive forces experienced by the lumbar region of the spine. In a preferred embodiment, the backrest is configured not to provide support directly to the lumbar region of the spine below the $2^{nd}$ lumbar vertebrae.

In some embodiments the support structure supporting the seat includes one or more chair legs. In other embodiments, the support structure comprises a base including a mechanism for controlling and adjusting the height of the seat. Some embodiments may include a footrest. The footrest may comprise a body with a triangular cross section and an off center axis extending between the first end and the second ends. In still other embodiments, the backrest includes a protrusion for providing additional support for the thoracic portion of the spine. In further embodiments, the backrest is coupled to a backrest support structure configured to apply a selected amount of traction on a users spine as the backrest is deflected backwards as the user leans back in the chair. The preferred amount of traction is between 1/16 inch and 1/4 inch for each 3/4 inch to 1 1/4inch of backwards deflection, and more preferably 1/8 inch for each 1 inch of backwards deflection of the backrest.

In some embodiments, the backrest support structure comprises a support arm made of a flat sheet of resilient material having a length divided into four regions comprising a lower end section, a lower intermediate section, an upper intermediate section, and an upper end section. The depth of the seat may be adjustable by moving the lower end section of the support arm relative to a coupling affixed to the underside of the seat, and the height of the backrest may be adjustable along a length of an upper end section of the support arm. In alternate embodiments, the support arm may be coupled to the seat support structure, rather than to the underside of the seat.

BRIEF DESCRIPTION OF THE DRAWINGS

The features of the present invention, which are believed to be novel, are set forth with particularity in the appended claims. The present invention, both as to its organization and manner of operation, together with objects and advantages provided by the invention, may best be understood by reference to the following description, taken in connection with the accompanying drawings, in which:

DETAILED DESCRIPTION OF THE INVENTION

Figure 1:
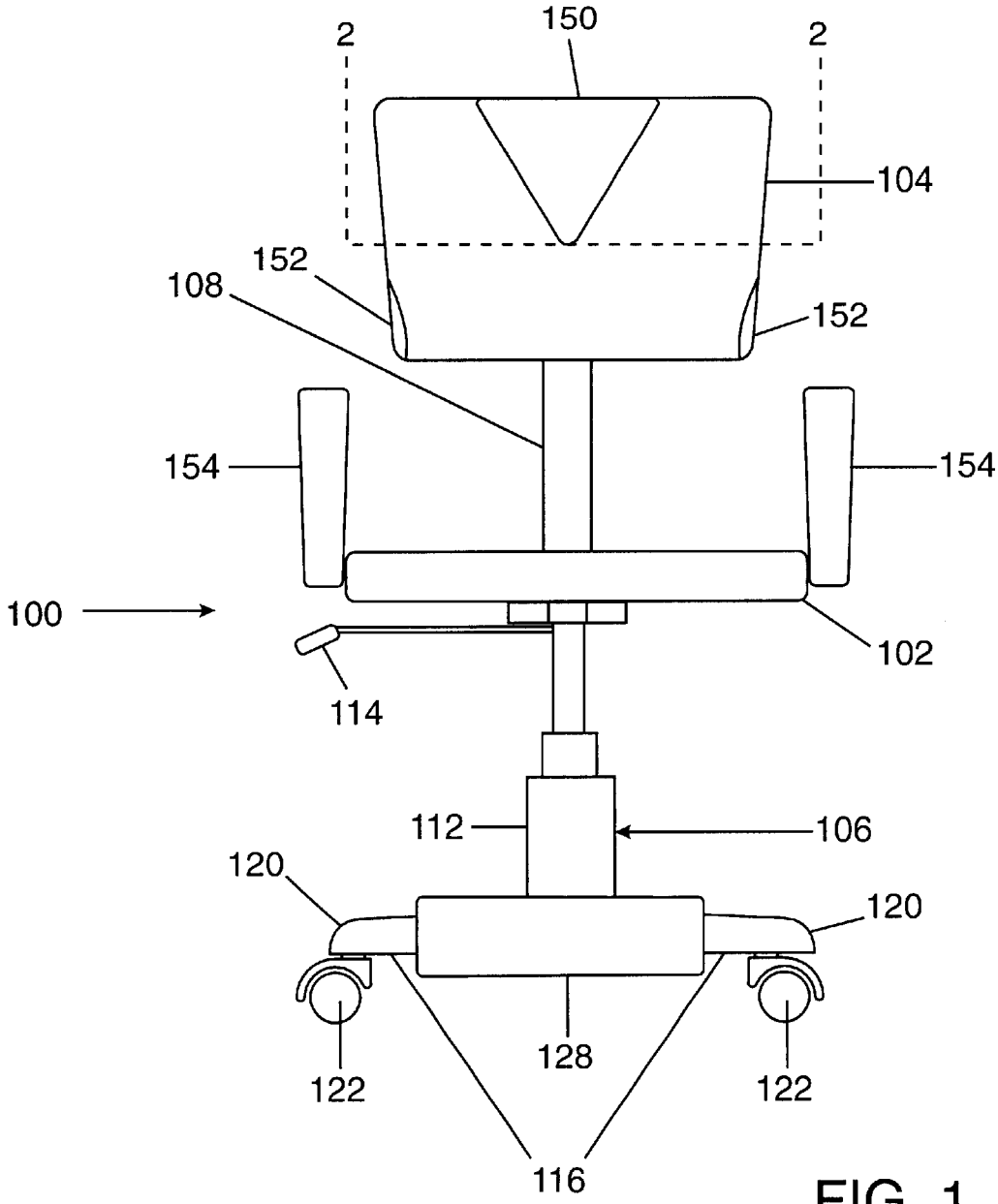
FIG. 1 shows a front view of a desk chair incorporating the invention.

The present invention comprises a seat or chair configuration that supports the users back at the junction between the lower thoracic vertebrae and the upper lumbar vertebrae and surrounding tissues. Support in this region assists the spine in maintaining a good posture, and also partially supports the weight of the spine above the lumbar region of the spine, which reduces the compressive forces experienced by the lumbar region of the spine. Another aspect of the invention comprises a seat or chair configuration that provides a selected degree of traction applied to the lumbar region of the spine when the user leans back in the seat or chair.

An exemplary configuration of a desk chair configured in accordance with the invention will be described in the figures and the text below. However, the invention may be incorporated into many other kinds of chairs or other kinds of seating, including but not limited to car seats, sofas, seats in public transportation vehicles, airlines, airport seats, public benches, and the like.

Referring to FIGS. 1 through 4, the exemplary chair 100 of the present invention generally comprises a seat 102, a backrest 104, a seat support structure 106 to support the seat 102, and a backrest support structure 108 that extends between the backrest 104 and the seat 102, although, in alternate embodiments the backrest support structure 108 could be coupled to the seat support structure 106.

Virtually any known means for supporting the seat 102 and backrest 104 may be used for the seat support structure 106, including but not limited to one or more legs, or pedestal configurations, which may or may not include wheels. The preferred seat support structure 106 is a wheeled pedestal 110 that is adjustable in height. The pedestal 110 shown in FIGS. 1 and 3 preferably comprises a telescoping column 112 that allows the height of the seat 102 to be adjusted to accommodate persons of different height or build. Any known means for adjusting the height of the column 112 may be used, however, in the preferred embodiment the telescoping column 112 is hydraulic, and includes a height adjustment arm 114 to engage and disengage a known locking system to hold the column 112 at the desired height. In this embodiment, the column 112 is under pressure, which biases the seat 102 upward. To adjust the height up, the user simply stands or otherwise removes his or her weight from the seat 102, releases the locking system using the height adjustment arm 114, and the seat 102 will rise. When the seat 102 reaches the desire level, the user re-engages the locking system using the height adjustment arm 114. To lower the seat 102, the user simply, releases the locking system using the height adjustment arm 114, then sits or otherwise places sufficient weight on the chair 100 to overcome the upward bias of the hydraulic pressure. When the seat 102 falls to the desired level, the user re-engages the locking system using the height adjustment arm 114.

The pedestal 110 preferably includes a plurality of arms 116 radiating from the bottom of the column 112 in a plane roughly perpendicular to the vertical axis of the column 112. Preferably, for stability, at least four such arms 116 radiate from the bottom end of the column 112, however, in alternate embodiments, other configurations may be used. The outer end 120 of each arm 116 preferably includes a castor or wheel structure 122 to allow the seat 102 to roll easily.

An adjustable footrest 128 is preferably coupled between two of the radiating arms. In a preferred embodiment best seen in FIG. 3, the footrest 128 is a bar or tube with a triangular cross-section, and including an off center axis 130 running through from one end of the footrest 128 to the other. The use of the off center axis 130 allows the level of the footrest 128 to be adjusted by selecting between the three sides of the footrest 128. The corners of the footrest 128 are preferably rounded in order to avoid the possibility of injury to the user. In alternate embodiments the chair 100 may not include a footrest 128, or the footrest 128 may be coupled to a portion of the column 112 rather than to the radiating arms 116. Many other useable footrest configurations are known and may be apparent to one skilled in the art, and such alternate designs are comprehended to be included in the invention.

The top of the column 112 is preferably coupled to the underside of the seat. The specific apparatus or means used to couple the top of the column 112 to the underside of the seat 102 is not critical to the invention, and any known and acceptable manner or means for doing so may be used. The connection between the top of the column 1 12 and the underside of the seat 102 preferably includes a pivot means to allow the seat 102 to rotate around a central axis of the column 112 of the pedestal 1 10 in a plane horizontal to the support surface or ground. The coupling may also allow the seat 102 to tilt back, if desired.

The upper surface of the seat 102 is preferably configured to conform to the posterior of a typical user. The particular configuration of the seat 102 is not critical to the invention, and a variety of known seat 102 configurations are useable. Generally the seat 102 comprises a bottom plate made of plastic or metal over which one or more layers of padding such as rubber, foam rubber, cotton, etc, are laid, and a seat 102 cover, made of any acceptable fabric material, synthetic webbing, or the like. The seat 102 may include any known and acceptable features for increasing the comfort of the seat.

Figure 3:
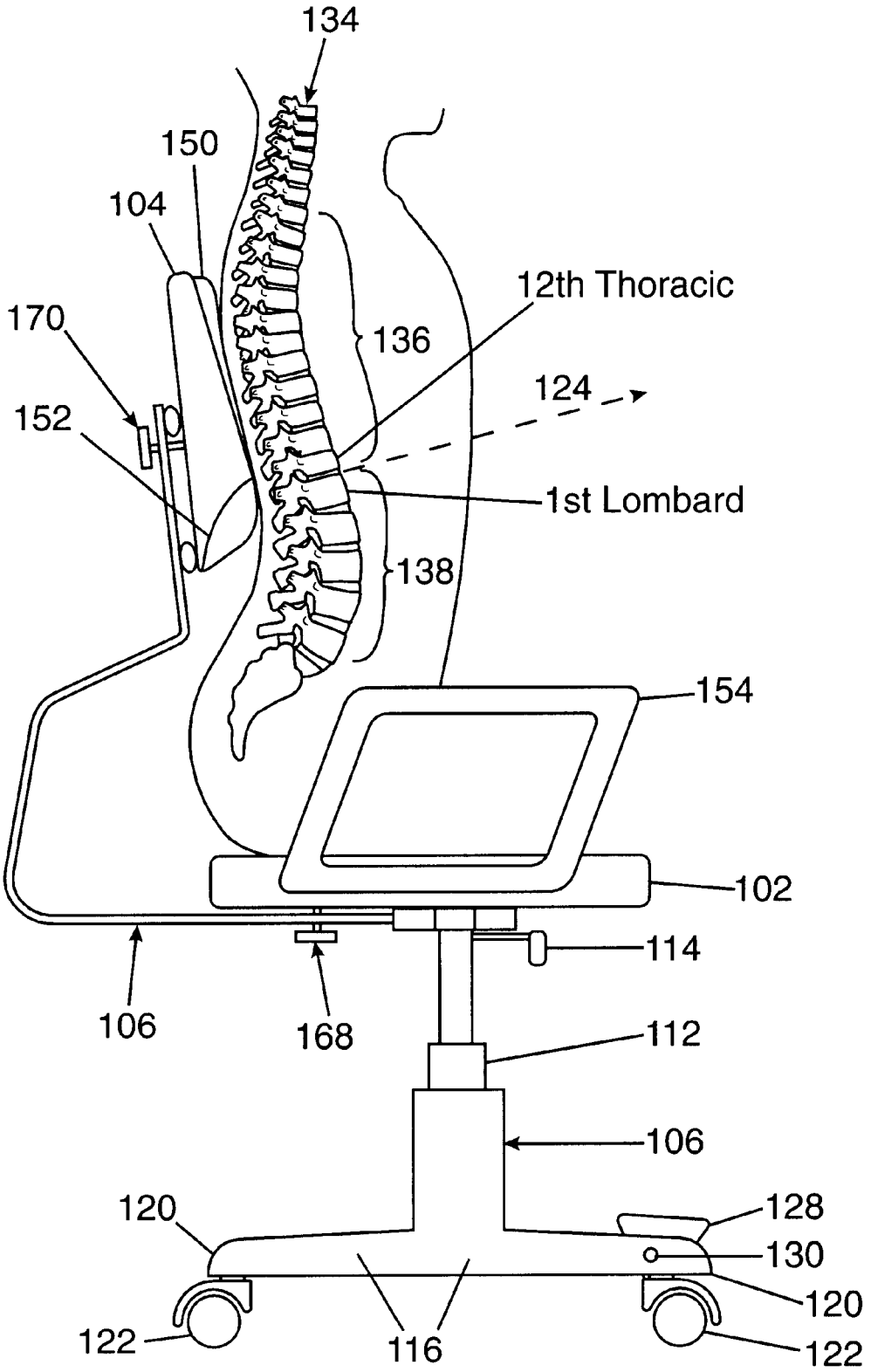
FIG. 3 shows a side view of the chair of FIG. 1 showing a user seated, and the relative position of the spine and backrest.

The backrest 104 is configured to provide primary support to the spine 134, seen in FIG. 3, at the junction between the lower thoracic vertebrae number 12, and the upper lumbar vertebrae number 1. In some embodiments, the area of primary support may be somewhat larger, including the $11^{th}$ thoracic vertebrae and the $2^{nd}$ lumbar vertebrae. This provides superior support over other pre-existing designs which tend to focus only on keeping the lumbar vertebrae in the preferred curved configuration, and do not provide support or lift to the rest of the spine 134. By providing support at the location preferred in the invention, the weigh of the upper portion of the "S" curve of the spine 134 is partially supported. This reduces wear on the lumbar region 136 of the spine 134, and improves the comfort of the chair 100. Providing primary support at the area between the $12^{th}$ thoracic and the $1^{st}$ lumbar vertebrae is novel, and may be is accomplished by a number of different backrest configurations comprehended by the invention.

Figure 2:
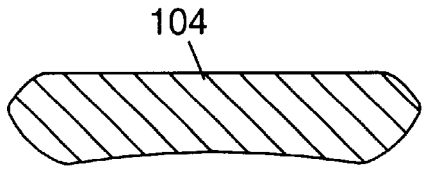
FIG. 2 shows a top cutaway view of the backrest of the chair of FIG. 1 taken along line 2—2.

One example of a backrest configuration that will accomplish the desired support is seen in the FIGS. 1 and 3. Referring specifically to FIG. 2, which is a cutaway top view of the backrest 104 of FIG. 1 taken along line A—A, the backrest 104 includes a curve to promote spinal alignment. The amount of curve may be varied within reasonable limits. The angle of the surface of the backrest 104 in contact with the user is between 0 and 22.5 degrees from vertical, and more preferably approximately 12.5 degrees from vertical.

The principle point of contact 140 on the backrest 104 is near the bottom of the backrest 104. The gap between the seat 102 and the bottom of the backrest 104 is intended to prevent lateral or side pressure against the lumbar vertebrae. Thus, the point of maximum force on the users back preferably results from the contact of the principle point of contact 140 on the backrest 104 against the target region or tissues roughly between the $12^{th}$ thoracic vertebrae and the $1^{st}$ lumbar vertebrae, or in some embodiments, between the $11^{th}$ thoracic vertebrae and the $2^{nd}$ lumbar vertebrae. The direction of force 124 applied to the users back at the principle point of contact 140 has both a vertical element or vector and horizontal element or vector. The vertical vector supports some of the weight of the spine 134 at the lumbar region 136, reducing the weight supported by the lumbar region 136 of the spine 134. The portions of the back rest above the principle point of contact 140 are intended to provide a comfortable resistance when the user leans back in the chair, and to assist the user in maintaining a proper curve of the thoracic region 138 of the spine 134. As long as the previously described features are present, the other features of the backrest 104 may be varied without leaving the scope of the comprehended invention.

In a preferred embodiment, a thoracic lift triangle 150 is also included on the backrest 104, best seen in FIG. 1. The thoracic lift triangle 150 is intended to contact the thoracic region 138 of the spine 134 to assist the user in maintaining proper posture.

In the preferred embodiment the chair 100 includes arm rests 154, however, virtually any arm rest configuration may be used, and the particular configuration selected is not critical to the invention. In alternate embodiments the chair 100 may be fabricated without armrests 154. In other embodiments, elbow alignment cut-outs 152 may be provided so that the user can pull his or her arms back on the arm rests 154 comfortably without encountering the backrest 104.

The chair 100 preferably allows the backrest 104 to move or tip back as the user leans back. Thus, an important feature in some embodiments of the invention is the applications of a selected degree of traction or stretching of the lumbar region 136 of the spine 134 when a user leans back in the chair. The amount of traction is preferably between approximately 1/16 inch and 1/4 inch for each approximately 3/4 inch to 1 1/4 inch of backwards deflection of the backrest, and more preferably approximately 1/8 inch for each approximately 1 inch of backwards deflection of the back rest.

A preferred embodiments of the backrest support structure will now be described, however, in alternate embodiments, virtually any back rest support structure or configuration may be used so long as it provides the desired traction. In a preferred embodiment, the traction may be obtained by using a backrest support arm 160 configured as shown in isolation in FIG. 4. The backrest support arm 160 is preferably constructed using steel, however, a variety of other materials may be useable. The configuration of the backrest support arm 160 may be easily varied from the description below by one skilled in the art to account for the use of a different thickness of material or the use of different materials, without leaving the spirit and scope of the invention.

Figure 4:
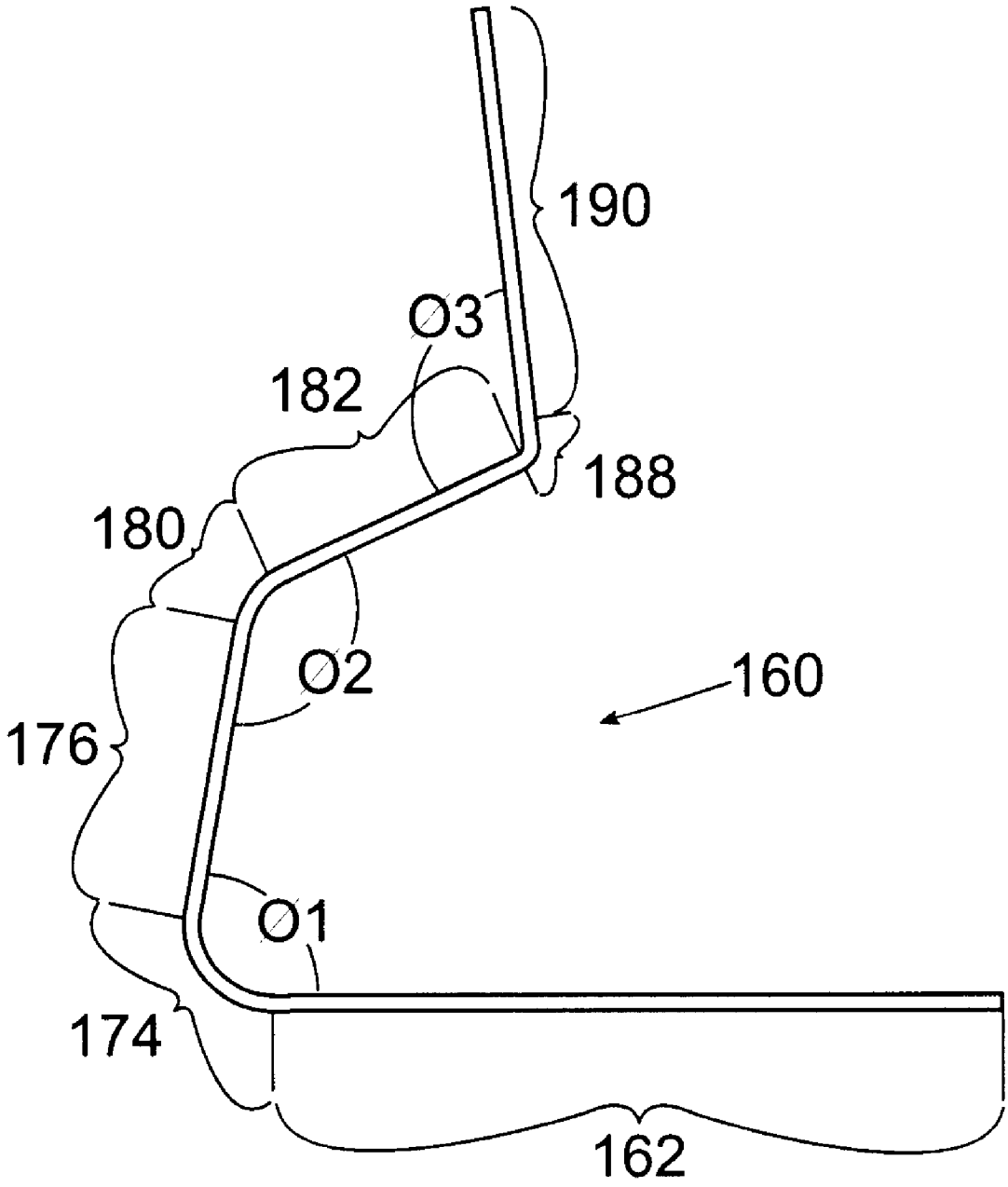
FIG. 4 shows an embodiment of the backrest support arm shown in isolation.

In the preferred embodiment shown in FIG. 4 the backrest support arm 160 preferably comprises a single unitary arm including four distinct sections. The lower end section 162 is intended to couple to the underside of the seat 102, preferably in a manner that allows the back rest support arm 160 to be adjusted backwards or forwards along the length of the lower end section 162 of the back rest support arm 160. This is intended to allow the back rest to be adjusted relative to the seat 102 in order to adjust the depth of the seat 102 to accommodate different users any mechanism for accomplishing the preferred adjustability may be used, and the particular method of adjustment is not critical to the invention. Virtually any known mechanism for adjusting the depth of the seat 102 may be used, and the particular mechanism selected is not critical to the invention. The number 170 is intended to generally indicate a generic known mechanism for accomplishing the desired adjustability.

The lower end section 162 of the support arm 160 preferably lies approximately horizontal to the ground, and may be of any desired length, but is preferably approximately 12.4 inches. A first bend 174 is made in the backrest support arm 160 between the lower end section 162 and the lower intermediate section 176 of the back rest support arm 160. The turn is preferably configured so that the an angle $\phi$1 of approximately 82 degrees is made between the lower end section 162 and the lower intermediate section 176. The lower intermediate section 176 is preferably approximately 6.8 inches long.

A second bend 180 is made between the lower intermediate section 176 of the backrest support arm 160, and the upper intermediate section 182 of the backrest support arm 160. The bend preferably creates an angle $\phi$2 of approximately 54.5 degrees from an axis of the lower intermediate support arm 160, as seen in FIG. 4. The length of the upper intermediate section 182 is preferably approximately 4.7 inches.

A third bend 188 is made between the upper intermediate section 182 and the upper end section 190. The third bend 188 preferably results in an angle $\phi$3 of approximately 70 degrees between the upper end section 190 and an axis of the upper intermediate section 182. The upper end section 190 may be any length sufficient to support the backrest 104. The upper end section 190 is preferably coupled to the back of the backrest 104 in a manner that allows the backrest 104 to be adjusted along the length of the upper end section 190 of the backrest support arm 160. The angle of the backrest is also preferably adjustable. Any known mechanism for adjusting the height and angle of the backrest may be used, and the particular mechanism selected is not critical to the invention. The number 168 is intended to generally indicate a generic known mechanism for accomplishing the desired adjustability both as to the height and angle of the backrest 104.

To those skilled in the art, many changes and modifications will be readily apparent from consideration of the foregoing description of a preferred embodiment without departure from the spirit of the present invention; the scope thereof being more particularly pointed out by the following claims. The description herein and the disclosures hereof are by way of illustration only and should not be construed as limiting the scope of the present invention which is more particularly pointed out by the following claims. For example, the invention has been disclosed in the context of a desk chair, however, the invention may be incorporated in to many other kinds of chairs or other seating.

What is claimed is:

1. A chair for providing primary support to a user's spine in a region between the $2^{nd}$ lumbar vertebrae and the $11^{th}$ thoracic vertebrae, the chair comprising:

a support structure, a seat operably connected to the support structure, and a backrest that is positionable to provide primary support to the user's spine in a region between the $2^{nd}$ lumbar vertebrae and the $11^{th}$ thoracic vertebrae, a vector of a force applied by said backrest includes both a vertical component and a horizontal component, wherein said support structure comprises a base including a mechanism for controlling and adjusting a height of said seat, wherein said base includes a footrest, and wherein said footrest comprises a body having a first end, a second end, and a triangular cross section, said footrest further including an off center axis extending between said first end and said second end.

2. A chair for providing primary support to a user's spine in a region between the $2^{nd}$ lumbar vertebrae and the $11^{th}$ thoracic vertebrae, the chair comprising:

a support structure, a seat operably connected to the support structure, and a backrest that is positionable to provide primary support to the user's spine in a region between the $2^{nd}$ lumbar vertebrae and the $11^{th}$ thoracic vertebrae, a vector of a force applied by said backrest includes both a vertical component and a horizontal component, wherein said backrest includes a triangle protrusion for providing additional support to the user's spine.

3. A chair for providing primary support to a user's spine in a region between the $2^{nd}$ lumbar vertebrae and the $11^{th}$ thoracic vertebrae, the chair comprising:

a support structure, a seat operably connected to the support structure, and a backrest that is positionable to provide primary support to the user's spine in a region between the $2^{nd}$ lumbar vertebrae and the $11^{th}$ thoracic vertebrae, a vector of a force applied by said backrest includes both a vertical component and a horizontal component, wherein said backrest is coupled to a backrest support structure, and wherein said backrest support structure is configured to apply a selected amount of traction on the user's spine as said backrest is deflected backwards as the user leans back in the chair, and wherein said selected traction is between 1/16 inch and 1/4 inch for each 3/4 inch to 1/4 inch of backwards deflection of said backrest.

4. A chair for providing primary support to a user's spine in a region between the $2^{nd}$ lumbar vertebrae and the $11^{th}$ thoracic vertebrae, the chair comprising:

a support structure, a seat operably connected to the support structure, and a backrest that is positionable to provide primary support to the user's spine in a region between the $2^{nd}$ lumbar vertebrae and the $11^{th}$ thoracic vertebrae, a vector of a force applied by said backrest includes both a vertical component and a horizontal component, wherein said backrest is coupled to a backrest support structure, and wherein said backrest support structure is configured to apply a selected amount of traction on the user's spine as said backrest is deflected backwards as the user leans back in the chair, and wherein said selected traction is 1/8 inch for each 1 inch of backwards deflection of said backrest.

5. A chair comprising:

a chair support structure, a seat operably connected to said chair support structure, and a backrest coupled to a backrest support structure, wherein said backrest support structure is configured to cause said backrest to apply a selected amount of traction on the user's spine as said backrest is deflected backwards as the user leans back in the chair, wherein said selected traction is between 1/16 inch and 1/4 inch for each 3/4 inch to 1 1/4 inch of backwards deflection of said backrest.

6. A chair comprising:

a chair support structure, a seat operably connected to said chair support structure, and a backrest coupled to a backrest support structure, wherein said backrest support structure is configured to cause said backrest to apply a selected amount of traction on the user's spine as said backrest is deflected backwards as the user leans back in the chair, wherein said selected traction is 1/8 inch for each 1 inch of backwards deflection of said backrest.

7. A chair comprising:

a chair support structure, a seat operably connected to said chair support structure, and a backrest coupled to a backrest support structure, wherein said backrest support structure is configured to cause said backrest to apply a selected amount of traction on the user's spine as said backrest is deflected backwards as the user leans back in the chair, wherein said backrest includes a triangle protrusion for providing additional support to the user's spine.

* * * * *